United States Patent [19]

Mucenieks

[11] 4,341,596

[45] Jul. 27, 1982

[54] METHOD OF PREPARING REINFORCED ASBESTOS DIAPHRAGMS FOR CHLORINE-CAUSTIC CELLS

[75] Inventor: Paul R. Mucenieks, Lawrenceville, N.J.

[73] Assignee: FMC Corporation, Philadelphia, Pa.

[21] Appl. No.: 196,715

[22] Filed: Oct. 14, 1980

[51] Int. Cl.[3] ..... C25B 13/00

[52] U.S. Cl. ..... 162/105; 162/106; 162/155; 162/169; 162/183; 204/295

[58] Field of Search ..... 162/105, 106, 155, 183, 162/169; 204/295, 296

[56] References Cited

U.S. PATENT DOCUMENTS

| | | | |
|---|---|---|---|
| 3,694,281 | 9/1972 | Leduc | 156/77 |
| 3,960,697 | 6/1976 | Kircher et al. | 204/252 |
| 3,980,613 | 9/1976 | Bachot et al. | 264/45.3 |
| 3,989,615 | 11/1976 | Kiga et al. | 204/252 |
| 4,020,235 | 4/1977 | Giuffre et al. | 428/443 |
| 4,031,041 | 6/1977 | Bouy et al. | 260/2.5 M |
| 4,056,447 | 11/1977 | Giuffre et al. | 204/98 |
| 4,065,534 | 12/1977 | Rechlicz et al. | 264/91 |
| 4,093,533 | 6/1978 | Beaver et al. | 204/296 |
| 4,098,672 | 7/1978 | Riley | 204/296 |
| 4,125,450 | 11/1978 | Degueldre et al. | 204/296 |
| 4,142,951 | 3/1979 | Beaver et al. | 204/98 |
| 4,186,065 | 1/1980 | Dilmore et al. | 204/295 |

*Primary Examiner*—Peter Chin

*Attorney, Agent, or Firm*—Robert W. Kell; Christopher Egolf

[57] ABSTRACT

A resin modified asbestos diaphragm is prepared by diluting a heat curable polyvinylidene fluoride homopolymer resin latex containing no more than about 5% resin solids with an aqueous solution containing about 4% to 5% sodium hydroxide. From about 6 to about 11 parts of asbestos fibers are then slowly added to this alkaline resin latex solution for each part of resin solids contained therein with agitation to produce a clear aqueous slurry of resin coated asbestos fibers. To this slurry is then added an aqueous solution of 10% to 15% sodium hydroxide to swell the asbestos fibers. The resulting slurry is deposited on a screen to form a diaphragm which is carefully dried and cured at elevated temperatures to complete the polymerization of the polyvinylidene fluoride resin and form a bonded resin coated asbestos fiber product that is dimensionally stable. Such resin modified asbestos diaphragms may be used in electrolytic cells for electrolyzing alkali metal halide solutions.

5 Claims, No Drawings

METHOD OF PREPARING REINFORCED ASBESTOS DIAPHRAGMS FOR CHLORINE-CAUSTIC CELLS

This invention relates to a dimensionally stable resin bonded asbestos diaphragm suitable for use in electrolyzing alkali metal chlorides.

Chlorine has been produced commercially by electrolysis of alkali metal chloride solutions in diaphragm cells wherein the anodic and cathodic compartments are separated by a porous wall permeable to the electrolyte. The porous wall is intended to separate the chlorine gas formed at the anode from the hydrogen gas formed at the cathode and to maintain the pH difference existing between the anolyte and catholyte in the cell.

In effect, two extremely diverse zones are formed during cell operation and in particular during the electrolysis of alkali metal chlorides, the reactions at the electrodes result as follows:

at the anode: $2Cl^- \rightarrow Cl_2 \uparrow + 2e$ at the cathode: $2H_2O + 2e \rightarrow H_2 = + 2OH^-$ In the catholyte, there is therefore an enrichment of $OH^-$ ions which, by electrosmosis, tend to migrate across the diaphragm towards the anode. The electrolyte in the anodic compartment usually has a pH between 2.0 and 4.5, whereas the electrolyte in the cathodic compartment has a pH above 12.0. It is, therefore, a function of the diaphragm to prevent such back-diffusion of the $OH^-$ ions.

Asbestos, chrysotile in particular, through its particular properties such as its structure characterized by tubular fibers and capacity of being reasonably resistant both in an acidic environment and in a strongly alkaline environment has been and still is used, except in rare cases in the making of such diaphragms. Usually, the diaphragms are made of asbestos fibers deposited directly onto the cathodic structure by pulling an asbestos fiber slurry under vacuum through a foraminous cathode structure.

Conventional asbestos diaphragms have several disadvantages. In the first place, they have on average a life of four to ten months and this contrasts greatly with the average life of the more recently developed dimensionally stable anodes, having an average life that can be measured in years of service. An increase in the service life of an asbestos diaphragm, therefore, will reduce the numerous replacements of the diaphragm with consequent loss of production.

Bonded asbestos diaphragms are well known for increased service life, and their use in the chloro-alkali diaphgram cells forms the substance matter of U.S. Pat. No. 4,142,951.

Fluorocarbon resins have previously been suggested as a suitable binding agent for asbestos fiber diaphragms. A fully polymerized thermoplastic resin is mixed with the asbestos slurry in powder or fiber form. It has been found that such mixtures do not yield a uniform diaphragm. When such modified diaphragms are heated to fuse the resin particles, the perculation rate of the diaphragm becomes highly variable and difficult to control. U.S. Pat. No. 4,070,257 describes mixing the asbestos and a resin directly in the slurry to be deposited, and British Pat. No. 1533429 describes pulling a resin suspension on the preformed asbestos layer. It has been found, that these methods as described in the prior art, do not yield a useful modified diaphragm because of the lack of homogenity which results in a diaphragm of non-reproducible properties.

In accordance with the present invention, a heat curable polyvinylidene fluoride homopolymer resin is absorbed onto asbestos fibers by suspending both materials in a solution of a weak alkali. The strength of alkali is chosen such, that it is not strong enough to coagulate the resin suspension but is strong enough to start swelling the asbestos and deposit the resin particles thereon. A suitable solution may be obtained by diluting the heat curable polyvinylidene fluoride homopolymer resin latex having a solids content no greater than about 50% with an aqueous sodium hydroxide solution containing from about 4% to about 5% sodium hydroxide. Asbestos fibers are then added to the resin latex with agitation to deposit resin on the asbestos fibers and form a slurry of resin coated asbestos fibers in water. Although this strength of sodium hydroxide is not sufficient to make the asbestos fully wetted in the solution, after about one hour at ambient temperature, the resin is absorbed onto the asbestos fibers. The amount of sodium hydroxide in the resin coated asbestos fiber slurry is then increased to wet the asbestos fibers. For example, the treated asbestos fibers can be transferred to a media normally used for diaphragm preparation, usually full strength cell liquor (10%–15% NaOH and 10%–15% NaCl) to form the slurry. The resin coated asbestos fibers are deposited on a screen to form a diaphragm and the diaphragms are dried slowly enough to avoid steam bubble formation. The diaphragms may be cured at an elevated temperature, i.e., 200° C.–300° C.

The process described in the present invention differs from other processes for the preparation of modified diaphragms by the method of preparation of the fluorocarbon resin containing asbestos slurry. The present invention consists of absorbing the fluorocarbon resin onto the asbestos in a weakly alkaline solution, then increasing the alkalinity until the asbestos is fully wetted and finally using the treated asbestos for diaphragm preparation.

As stated above, the modified asbestos diaphragms of this invention may be prepared by adding with stirring to a heat curable polyvinylidene fluoride homopolymer resin latex having a solids concentration no greater than about 5%, an aqueous caustic solution containing no more than about 5% sodium hydroxide. If desired, cell liquor (12% NaOH and 12% NaCl) diluted with water to contain no more than about 4% sodium hydroxide and about 4% sodium chloride may be substituted for the aqueous caustic solution. It has been found that more concentrated solutions of cell liquor, if added to the homopolymer resin, may coagulate the suspension.

The amount of the caustic solution added to the homopolymer latex should be sufficient to freely suspend the asbestos fibers which are added in a subsequent step so that the homopolymer resin particles are deposited upon the asbestos fibers and the aqueous mixture becomes a clear solution of dispersed resin coated asbestos fibers. Conveniently, about 50 to 100 parts of 5% caustic or diluted cell liquor will be added with stirring to the polyvinylidene chloride homopolymer resin suspension for each part of asbestos to be added in the next step.

The asbestos fibers are next added with agitation to the alkaline mixture containing polyvinylidene chloride homopolymer resin latex and caustic. The ratio of asbestos fibers to resin solids in the latex may vary from about 6:1 to about 14:1. It has been found that if the ratio of asbestos fibers to polyvinyl fluoride resin is about 8:1, a uniform and reproducible diaphragm characterized by long life and efficient operation results. Agitation is conveniently effected by bubbling air through the mixture and as the resin particles are deposited on the asbestos fibers, the solution will clear to form a dispersion of resin coated asbestos fibers.

The wetting of the resin coated asbestos fibers may at this time be completed by the addition with agitation of full strength cell liquor (10%–15% NaOH and 10%–15% NaCl) to the slurry. The amount of cell liquor added is sufficient to stabilize the suspension of the asbestos fibers and to adjust the solids content of the slurry to that which is convenient in the next step of forming the diaphragm. Preferably, the amount of caustic solution added in this second step is sufficient to produce a slurry containing 0.5%–1.5% solids.

A diaphragm may be formed from this slurry of resin coated asbestos fibers by depositing the slurry on a steel cathode screen commonly used in a chlorine-caustic cell. The screen cathode is immersed in the resin coated asbestos fiber slurry and a vacuum is applied to the hydrogen side of the screen. The diaphragm is compacted on the screen by increasing the vacuum to 600–700 mm Hg. The total diaphragm solids applied to the screen is about 1–3 kilograms/square meter; preferably 1.3–2 kilograms/square meter.

The formed diaphragms are cured at elevated temperature in an oven equipped with a programmable temperature controller, according to the resin manufacturer's instructions, taking great care to avoid the formation of steam bubbles which may destroy the deposit. In general, the temperature may be raised to 60° C. and then increased slowly (over one to two hours) from 60° C. to 95° C. The temperature is then kept at 95° C.–100° C. for four hours, increased further from 100° C. to 225° C. over one-half to one hours and curing completed at 225° C.–230° C. for one to two hours.

It is an advantage of the process to be described that the resulting modified diaphragms are more dimensionally stable and free of swelling than are regular asbestos diaphragms. The diaphragms of the present invention also consume less asbestos in their manufacture and permit the placing of anodes closer to the cathodes in the electrolysis cells. Other advantages of the modified diaphragms to be described are that they yield chlorine with a low hydrogen content and reduce the voltage drop to the cell.

For the purpose of giving those skilled in the art a better understanding of the invention, the following example is given.

EXAMPLE I

To 12 kilogram of polyvinylidene fluoride homopolymer resin latex containing 23% solids and manufactured by Pennwalt Corporation, Pennwalt Building, 3 Parkway, Philadelphia, Pa. 19102, under the trademane KYNAR ® latex 32 is added 51 kilograms of distilled water with rapid stirring. The mixture, after dilution with water, weighs 63 kilograms and contains 4.38% resin solids. The distilled resin latex is "aged" by slowly stirring for one hour. The aging is required to equilibrate the composition of the suspension.

To this diluted resin latex slurry (63 kilograms) is then added with stirring 1,100 kilograms of an aqueous solution containing 4% sodium hydroxide and 4% sodium chloride. The mixture is observed for about ten minutes to be certain that no coagulation occurs and then 11 kilograms of No. 1 asbestos and 11 kilograms of No. 2 asbestos are added over a period of one-half hour with continuous agitation (by blowing air bubbles through the solution). Agitation is continued for another hour after all of the asbestos is added. The amount of asbestos fibers in suspension is 1.85% (2.09% total solids).

To this suspension of asbestos fibers and diluted resin latex (1,185 kilograms) is added 1,200 kilograms of cell liquor (an aqueous solution of 12% sodium chloride and 12% sodium hydroxide) to improve the dispersion of the asbestos fibers. The amount of asbestos in suspension at this stage is 0.92% (1.04% total solids). A diaphragm for use in a chlorine-caustic cell is deposited on a mild steel screen cathode having an area of 18 square meters by immersing the screen cathode in the asbestos fiber-resin latex mixture and applying a vacuum to the hydrogen side of the screen. The diaphragm is compacted on the screen by increasing the vacuum to 600 mm Hg, and is cured in an oven equipped with a programmable temperature controller. To cure the formed diaphragm, the temperature of the oven is increased rapidly to 60° C., raised slowly (over two hours) to 95° C. and maintained at a 95° C.–100° C. for four hours. The temperature is then increased over a period of one hour to 225° C. and maintained at 225° C.–230° C. for one hour. The resin modified asbestos diaphragm is then allowed to cool slowly to ambient temperature and is ready for use or can be stored until needed.

I claim:

1. A method of preparing a resin modified asbestos diaphragm for use in an electrolytic cell which comprises:

(a) diluting a heat curable polyvinylidene fluoride homopolymer resin latex having a solids content no greater than about 5% with an aqueous sodium hydroxide solution containing from about 4% to about 5% sodium hydroxide, the amount of sodium hydroxide added to the homopolymer latex being sufficient to freely suspend the asbestos fibers which are added in a subsequent step so that the homopolymer resin is deposited upon the asbestos fibers;

(b) adding asbestos fibers to the diluted resin latex with agitation to deposit resin on the asbestos fibers and form a slurry of resin coated asbestos fibers in water said asbestos fibers being present in a ratio of from about 6:1 to about 14:1 asbestos fibers to resin solids;

(c) increasing the amount of sodium hydroxide in the resin coated asbestos fiber slurry to wet the asbestos fibers and to form a stable resin coated fiber dispersion;

(d) depositing the resin coated asbestos fibers on a screen to form a diaphragm, and (e) curing the diaphragm at elevated temperature.

2. The method of claim 1 wherein said aqueous sodium hydroxide solution contains about 4% sodium hydroxide and about 4% sodium chloride.

3. The method of claim 1 wherein the diaphragm is dried at about 95° C.–100° C. for about four hours.

4. The method of claim 1 wherein the diaphragm is cured at about 225° C.–230° C. for about one to two hours.

5. The method of claim 1 wherein the amount of sodium hydroxide in the resin coated asbestos fiber slurry is increased to wet the asbestos fibers by the addition of cell liquor.

* * * * *